United States Patent [19]

Ebelt

[11] 4,094,103

[45] June 13, 1978

[54] WORKPIECE-HOLDING FIXTURE FOR HONING MACHINE

[75] Inventor: Günter Ebelt, Westerholt, Germany

[73] Assignee: Maschinenfabrik Gluckauf Beukenberg G.m.b.H., Gelsenkirchen, Germany

[21] Appl. No.: 765,944

[22] Filed: Feb. 7, 1977

[30] Foreign Application Priority Data

Feb. 6, 1976 Germany ..... 2604602

[51] Int. Cl.[2] ..... B24B 33/02

[52] U.S. Cl. ..... 51/34 F; 51/227 R; 51/349

[58] Field of Search ..... 51/34 F, 34 H, 34 J, 51/34 K, 165.93, 290, 349, 227 R; 269/244, 265, 287; 408/104

[56] References Cited

U.S. PATENT DOCUMENTS

| | | | |
|---|---|---|---|
| 17,960 | 8/1857 | Dillaway | 51/227 R X |
| 2,315,062 | 3/1943 | Kline | 51/349 X |
| 3,557,492 | 1/1971 | Greenberg | 51/227 R X |

FOREIGN PATENT DOCUMENTS

| | | | |
|---|---|---|---|
| 1,806,320 | 5/1970 | Germany | 51/34 H |
| 20,536 of | 1907 | United Kingdom | 51/227 R |

*Primary Examiner*—Gary L. Smith
*Attorney, Agent, or Firm*—Michael J. Striker

[57] ABSTRACT

A honing machine has a floating honing tool which is vertically reciprocal and rotatable about a vertical axis. A workpiece frame under the machine has a pair of workpiece-clamping stations each of which has an upper plate and a lower plate formed with a throughgoing aperture for passing the tool. The confronting faces of these plates are provided with centering formations and the lower plate can be displaced up toward the upper plate to clamp a tubular workpiece against it. Each upper plate can be displaced horizontally out of the way to allow the respective station to be loaded and unloaded. The workpiece frame itself can be displaced horizontally under the machine in order to align either of the stations with the tool so that as a workpiece in one station is being honed the other station can be emptied and reloaded.

8 Claims, 3 Drawing Figures

WORKPIECE-HOLDING FIXTURE FOR HONING MACHINE

CROSS REFERENCE TO RELATED APPLICATIONS

This application is related to my commonly filed and assigned patent applications Ser. Nos. 765,945 and 765,946 the entire disclosures of which are herewith incorporated by reference.

BACKGROUND OF THE INVENTION

This invention relates to a honing machine which has a vertically reciprocable and simultaneously rotatable honing tool for honing workpiece recesses of substantially circular cross-section, and a workpiece receiving frame, disposed above or below the plane of the floor, with clamping means for locating the workpieces.

In a known construction of a honing machine of this kind a workpiece to be machined, for instance a tube, is clamped in a stationary receiving frame with the honing tool inoperative and is then honed. After the end of each honing operation, the honing tool is stopped, the honed workpiece is removed from the receiving frame, and a fresh unhoned workpiece is placed in it. The main disadvantage of this known machine is the ratio between the honing time and the time taken in clamping, unclamping, and interchanging the workpieces. The honing machine is inoperative for too long and is not utilized to its full capacity. There is a low production rate of honed workpieces per shift. Moreover, the number of workpieces honed per shift depends on the speed and skill with which the operator substitutes an unmachined workpiece for a honed one.

SUMMARY OF THE INVENTION

It is an object of the invention to provide an improved machine of the kind specified wherein the honing time is considerable increased in comparison with the time for exchanging the workpieces, so that the number of workpieces honed per shift is increased and the honing machine can be used more economically.

Accordingly, the present invention provides a honing machine which has a vertically reciprocable and simultaneously rotatable tool for honing workpiece recesses of substantially circular cross-section, and a workpiece-receiving frame carrying clamping means for holding a workpiece to be honed. The receiving frame is displaceable horizontally transversely of the direction of the stroke of the honing tool and comprises at least two clamping stations spaced apart in the direction of displacement of the frame which is lockable with a selected clamping station in the honing position.

A honing machine constructed in accordance with the invention enables workpieces to be changed during the actual honing operation. The time taken for workpiece interchange is consequently superimposed on the honing time, during which hitherto the operator performed merely a supervisory function. Now the honing machine need only be stopped for the time necessary to displace the receiving frame from the workpiece interchange position into the machining position, and vice versa. To this end, the receiving frame comprises two clamping stations which are disposed so that, at any time, one is in the working position and the other in the workpiece interchange position. Workpiece interchange is therefore carried out alternately on the left-hand side and on the right-hand side alongside respective machine uprights i.e., therefore in areas where the operator is not endangered by the upward and downwardly moving parts of the honing machine. The invention consequently not only ensures a much more economical utilization of the honing machine, but it also provides extra safety over the prior art constructions in which, although workpiece interchange takes place with the honing machine stopped, the interchange is still performed in the working path of the honing tool. The receiving frame can be displaced jointly with respect to the two clamping stations. Alternatively, however, the clamping stations can be movable relative to one another. Moreover, the clamping stations which are adjustable in dependence on the workpiece, themselves allow quick adaptation to different workpiece lengths and diameters, thus further improving the economic utilization of a honing machine embodying the invention.

The receiving frame can be displaced transversely of the direction of the stroke by known drive means, such as, for instance, chain drives. However, according to a preferred embodiment of the invention the receiving frame is displaced along a constraining guide by means of at least one hydraulically actuatable thrust piston unit. In conjunction with the constraining guide the thrust piston unit ensures in a relatively simple manner an accurate positioning of the receiving frame, which can however be varied as required. To this end the piston unit can have a control system operable from a control desk of the machine.

According to further advantageous feature of the invention, each clamping station has a vertically guided, steplessly positionable clamping table forming the receiving base, and an upper workpiece abutment which can be located on the frame at least for the period of machining, the clamping table and abutment each being formed by a clamping plate formed with a central aperture and being provided with means for the axial and radial centering of the workpiece. The stepless adjustability of the clamping table in the vertical direction ensures accurate adaptation to the particular workpiece length. The workpiece is clamped axially between the clamping table and the abutment. The abutment is located on the frame only for the machining time. During workpiece interchange the abutment is removed from the zone of the clamping station, so that unimpeded access is afforded. The honing tool passes unimpeded through the central apertures in the plate-like clamping table and workpiece abutment. The means for centering the workpiece are disposed above the clamping table and below the abutment. They ensure without further steps the machining position of the workpiece.

Preferably, the centering means are formed by four radially displaceable, lockable clamping jaws off-set by 90° in relation to one another. The clamping jaws can be adjusted mechanically, hydraulically, pneumatically or electrically. For mass production operation they are adjusted once and for all to the dimensions of the workpiece to be machined and then remain in that position. The clamping jaws have centering surfaces inclined in the direction of the central aperture and adjoining stop surfaces bent at an angle of 90° to the direction of the stroke. When, for instance, a tubular workpiece is placed on the clamping table, the centering surfaces ensure the self-centering of the workpiece until it abuts the stop surfaces. The same purpose is also served by the clamping jaws of the abutment when the clamping table and abutment are moved together.

The clamping table may be adjusted by at least one hydraulically operable thrust piston unit operating substantially parallel to the direction of the stroke of the honing tool, in relation to a baseplate guided on two columns extending vertically through the clamping station. After the rough adjustment of the baseplate to the length of the workpiece to be machined, the clamping table is adjusted in relation to the baseplate by means of the thrust piston unit, so that the workpiece is clamped between the clamping table and the workpiece abutment. Conveniently the baseplate has a travel indicator which shows the position in height of the baseplate on the honing machine control desk. The guide columns prevent any tilting of the baseplate and can be of various designs such as of round, or polygonal cross-section. However, advantageously they are formed by tubes. More than one thrust piston unit can also be incorporated between the baseplate and the clamping table. In that case pressure is in the same direction of two spaced locations. To adjust the height of the baseplate in the receiving frame each clamping station may have at least one threaded spindle which can be rotated by a motor and is connected to the baseplate. A threaded spindle extends through the clamping station in the longitudinal direction so that, when the spindle is turned in one direction or the other, the baseplate is pushed along the guide columns. Preferably the baseplate is slidably guided on the guide columns. The spindle can be driven by an electric motor or a hydrostatic motor. Two spindles driven in parallel can be substituted for a single spindle. The two spindles can then be disposed adjacent the guide columns.

The workpiece abutments may be displaced transversely of the direction of displacement of the frame by hydraulically operable thrust piston units disposed on both sides of the machine upright and forming a component of alternating retaining means. The workpiece abutments are consequently displaced from the frame to the alternating retaining means by means of the thrust piston units workpiece interchange. Advantageously, the abutments are mounted on rollers. After insertion of the fresh workpiece the particular abutment is then moved back from the alternating retaining means on to the frame and clamped thereto.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

SPECIFIC DESCRIPTION OF A PREFERRED EMBODIMENT

Figure 1:
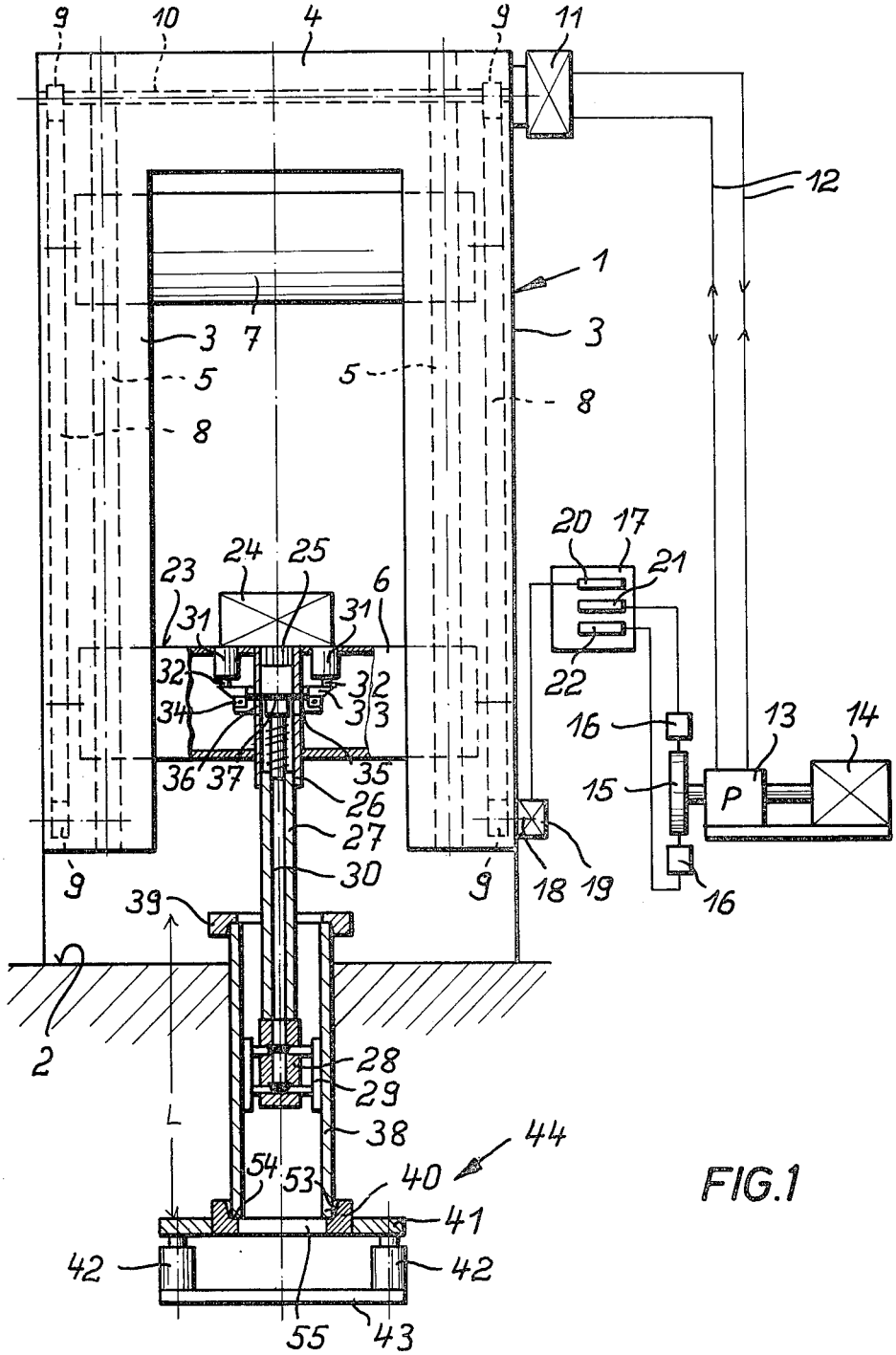
FIG. 1 is a partly diagrammatic and partly broken-away side view of the apparatus according to the present invention.

FIG. 1 shows a portal-like machine upright or support 1 which is attached, for instance, to the floor 2 of a workshop. The machine support has two upright lateral supports 3 and a portal or crosspiece 4 interconnecting the top ends of the lateral supports 3 which, like the crosspiece 4, are U-shaped in cross section.

Extending vertically through the channel of each of the lateral supports are two parallel columns 5 disposed one behind the other. The two front columns guide a casing-like cross-member 6, while the two rear columns guide a counterweight 7. The cross-member 6 and the counterweight 7 are moved upwardly and downwardly in opposite directions by means of endless sprocket chains 8 oriented in respective vertical planes in the supports 3. In the top and bottom ends of the supports 3 the sprocket chain 8 each pass over two sprocket wheels 9 spaced apart horizontally one behind the other. The top rear sprocket wheels are disposed on a common shaft 10 driven by a hydrostatic motor 11 connected via fixed hydraulic lines 12 to a controllable hydrostatic pump 13 driven continuously by an electric motor 14. An adjusting device 15 with control heads 16 connected to a controller 17 adjusts, for instance, the pivoting swash plate of a variable axial-piston pump constituting the pump 13 to reverse same.

Disposed on the shaft 18 of the bottom front sprocket wheel 9 is a rotation pulse transmitter 19. The pulses emitted by the pulse transmitter 19 are fed to an electronic forward and backward counter 20 of the controller 17 which can be preprogrammed by means of two switches 21 and 22 which determine the two end positions of the cross-members 6 (in dependence on the required stroke length and stroke position). The information of the position of the cross-member communicated to the forward and backward counter 20 is evaluated by the controller 17, which delivers corresponding signals to the control heads 16 of the adjusting device 15 which reverses the pump 13 at the end of each stroke.

Attached to the top 23 of the cross-member 6 is a hydrostatic motor 24 having a drive or output shaft 25 directly connected to a drive sleeve or spindle 26 which is mounted in the cross-member and in which a honing rod 27 can be secured. The honing rod carries at its bottom free end a honing tool 28 having radially displaceable grinding stones or members 29 which are displaced radially by an actuating rod 30 which extends longitudinally through the hollow honing rod 27 and is acted upon by two hydraulically actuatable thrust piston units 31 secured to the cross-member 6. The piston rods 32 of the thrust piston units 31 act on a thrust plate 33 carried on an axial-thrust bearing 34 which is mounted on a flange sleeve 35 and encircles the driving spindle 26 with a sliding clearance. At the level of the flange sleeve 35 the wall of the drive spindle 26 has two diametrically opposed slots 36 through which passes a transverse yoke 37 fixed in the walls of the flange sleeve. The transverse yoke acts on the top end face of the actuating rod.

In the embodiment illustrated in FIG. 1, the honing tool 28 is in the central longitudinal region of a tubular workpiece 38 held in a clamping device formed by two four-part rings 39 and 40. The workpiece 38 is attached to a workpiece-receiving frame 44 described in greater detail with reference to FIGS. 2 and 3 and constituted by clamps 39 and 40 and the plate-like clamping table 41 which can be vertically displaced in relation to a baseplate 43 by means of hydraulically actuatable thrust piston units 42.

Figure 2:
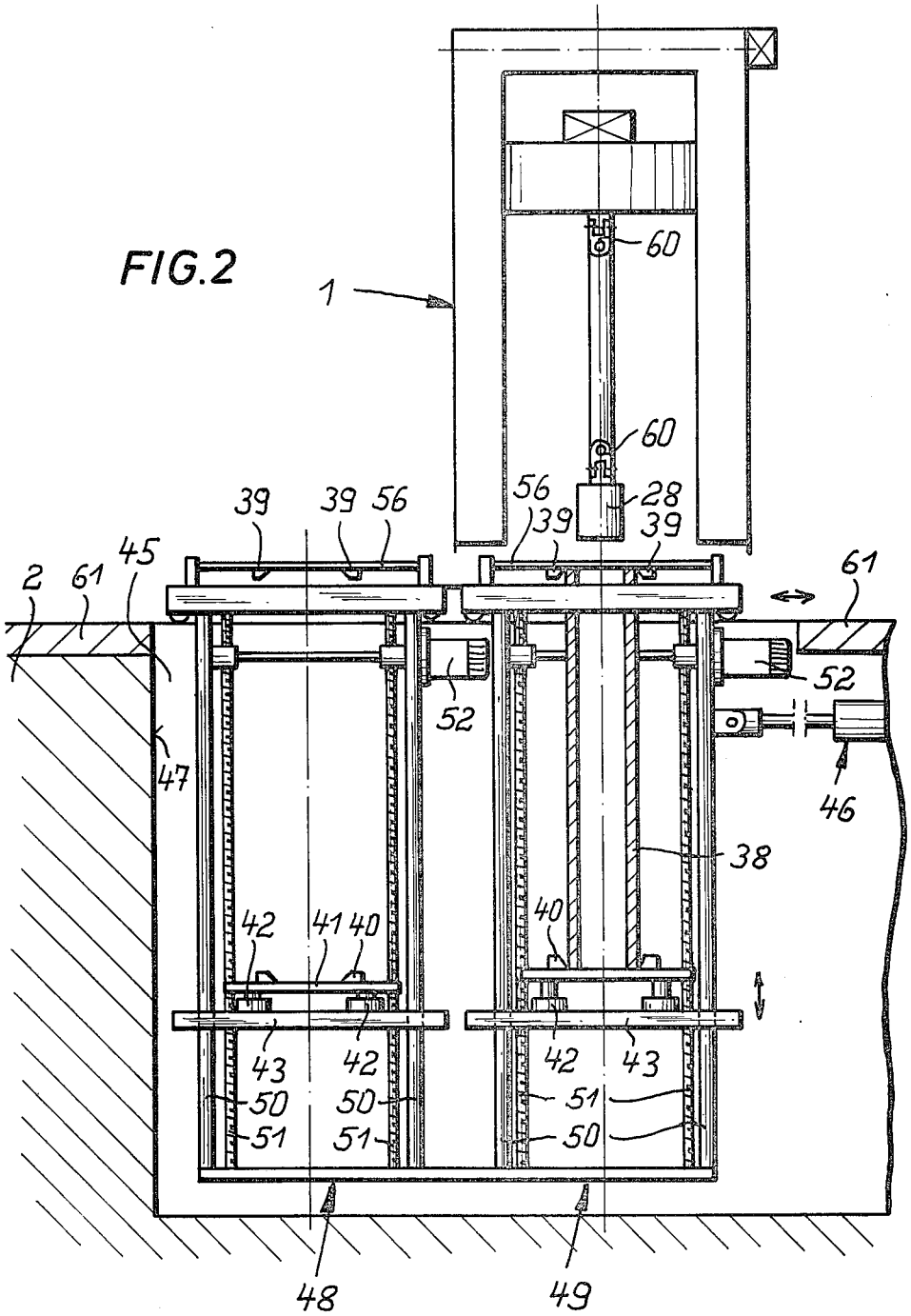
FIG. 2 is a top view of the workpiece frame of this invention.

As shown in FIG. 2 the floor 2 below the machine frame 1 is formed with a recess or well 45 in which the workpiece-receiving frame 44 can be moved transversely of the axial direction of the stroke of the honing tool 28 by means of a hydraulically operable thrust piston unit 46 attached on one side to the receiving frame and on the other side to the wall opposite the end wall 47 of the well 45.

The receiving frame 44 has two clamping stations 48, 49 which can be moved by the thrust piston unit 46 out of the position shown in FIG. 2 with clamps 47 below the frame 1 into a position in which the clamping station 48 is below the machine frame 1.

Each clamping station 48 and 49 has two guide columns 50 on which the respective baseplate 43 can move axially up and down. The vertical movement of each plate 43 is produced by two lateral threaded spindles 51 which are threaded through the baseplate 43 and are jointly driven by a respective motor 52. Attached to each baseplate 43 are the two thrust piston units 42 engaging below the plate-like clamping table 41 on which are disposed the four clamping jaws 40 offset by 90° from one another. The clamping jaws can be adjusted and locked mechanically by hand and have inclined centering surfaces 53 (shown in greater detail in FIG. 1) and stop surfaces 54 for the abutment of the end faces of the workpiece 38 to be machined. Each clamping table 41 is formed with a central aperture 55 through which the honing head 28 can pass.

Figure 3:
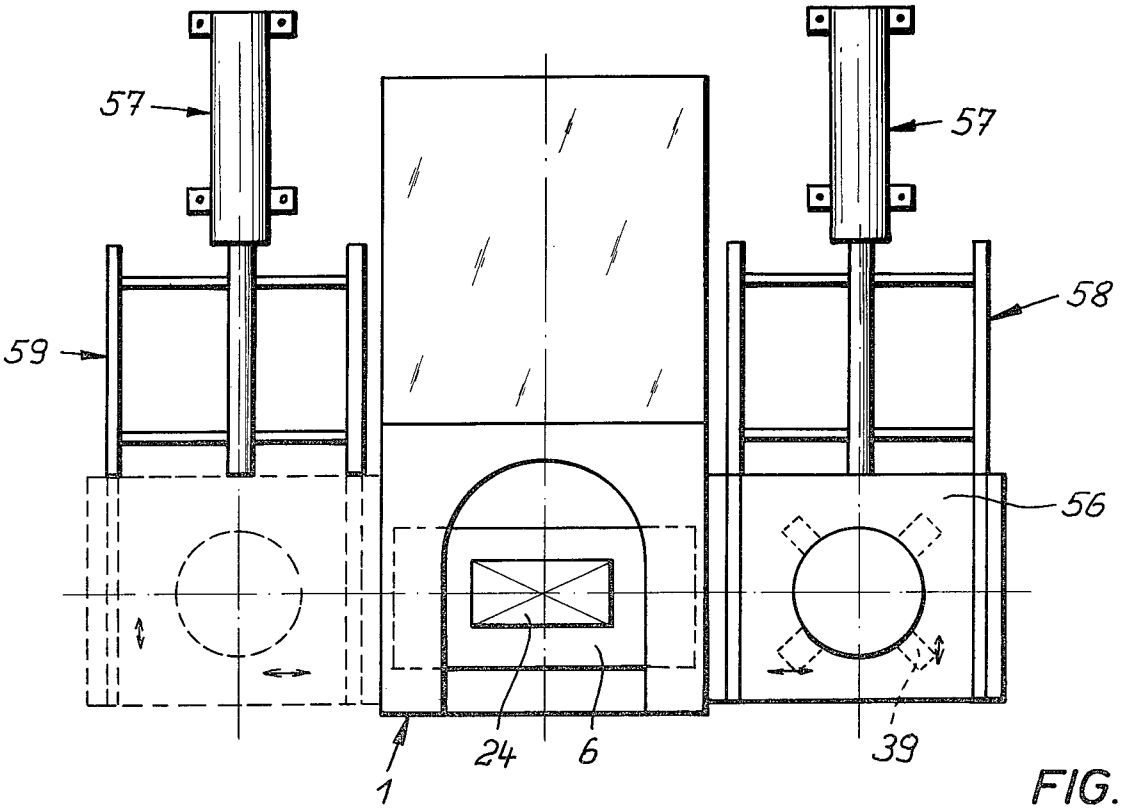
FIG. 3 is a vertical section through the apparatus of this invention taken in a direction perpendicular to the direction of view of FIG. 1.

Also associated with each clamping station 48, 49 is as shown also in FIG. 3, a plate-like workpiece abutment 56 having on its underside four clamping jaws 39 corresponding to the jaws 40 of the clamping table. The abutments 56 can be moved over and centered on the frame 44 by means of hydraulically operable thrust piston units 57. From the frame 44 the abutments 56 are slid on alternating retaining means or guides 58 and 59 disposed on respective sides of the machine frame 1. For this purpose either the alternating retaining means 58 and 59 or the abutments 56 can have rollers. The dot-dash on the left-hand side of the machine frame in FIG. 3 show the abutment 56 on the clamping station 48 when the latter is in the position shown in FIG. 2.

FIG. 2 shows the clamping station 48 without any workpiece. It can be seen that the thrust piston units 42 disposed on the baseplate 43 are retracted. The abutment 56 has been moved back on top to the retaining means 59 (FIG. 3). In this position a fresh workpiece 38 can be introduced into the clamping station 48 and placed on the respective clamping jaws 40 of the respective clamping table 41. For this purpose base 43 can be moved to the top of the station 48 on the spindles 51. The centering surfaces of the clamping jaws guide the lower end face of the workpiece onto the respective stop surfaces 54. Then the baseplate 43 is again lowered by the respective spindles 51 to a position spaced from the top edge of the recess 45 by a distance somewhat greater than the axial length L of the workpiece 38. The respective abutment 58 is then moved by the respective thrust piston unit 57 onto the frame 48 and the thrust piston units 42 are actuated so that the workpiece 38 is centered in the clamping position 49 between the clamping table 41 and the workpiece abutment 56. The centering in the clamping jaws 39 and 40 can be fairly rough, since universal joints 60 in the floating-type honing rod compensate for misalignment of the longitudinal axes of the workpiece 38 and honing tool 29.

FIG. 2 shows a sliding cover 61 which is movable with the receiving frame 44 to cover the well 45 when the frame is moved into the other end position. A similar cover is disposed on the other side of the recess.

It will be understood that each of the elements described above, or two or more together, may also find a useful application in other types of grinding systems differing from the types described above.

While the invention has been illustrated and described as embodied in a honing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A machine for honing a recess in a workpiece with a honing tool, said machine comprising:

means for rotating said tool and for simultaneously reciprocating said tool in a predetermined vertical direction;

a receiving station displaceable transverse to said direction adjacent said tool and having a pair of clamping stations each provided with a lower table formed with a lower aperture, centering formations for said workpiece around said lower aperture, means for vertically displacing said lower table, an upper abutment plate formed with a throughgoing upper aperture vertically in line with said lower aperture, and centering formations for said workpiece around said upper aperture and directed toward said lower table;

means at each of said stations for holding a respective workpiece with its respective recess directed at said tool;

means for displacing said frame between a pair of positions in each of which a respective one of said stations is aligned in said direction with said tool; and means for displacing said upper plates transverse to said direction into and out of position with the respective upper apertures aligned vertically with said lower aperture.

2. The machine defined in claim 1 wherein said means for displacing includes a hydraulic ram connected to said frame.

3. The machine defined in claim 1 wherein each of said formations is constituted by a plurality of jaws angularly equispaced about the respective aperture and radially displaceable toward and away from the respective aperture, said apertures of each station being aligned in said direction with said tool when the respective station is positioned in alignment with said station.

4. The machine defined in claim 1 wherein each of said formations has a centering surface inclined to said direction and between said surface and said aperture a stop surface substantially perpendicular to said direction.

5. The machine defined in claim 1 wherein each of said tables includes a vertically displaceable base and a lower plate formed with the respective aperture and carrying the respective formations, each of said stations being provided with means for relatively displacing the respective lower plate relative to the respective base.

6. The machine defined in claim 5 wherein said means for vertically displacing said lower table includes at least one vertically nondisplaceable but rotatable upright threaded spindle at each station threadedly engaging the respective base and means for rotating said spindle.

7. The machine defined in claim 1 wherein said clamping stations are independently displaceable transverse to said direction.

8. A honing machine for honing a cylindrical recess in a workpiece, said machine comprising:

a support;

a vertically displaceable and rotatable tool spindle on said support;

means at the lower end of said spindle for holding a honing tool;

means for vertically reciprocating said spindle and said tool relative to said support;

means for rotating said spindle relative to said support about a vertical axis;

at least one universal joint in said spindle, whereby said tool can be deflected horizontally while rotating;

a workpiece frame underneath said support having a pair of workpiece stations;

a workpiece clamp at each station comprising a vertically displaceable lower plate formed with a throughgoing aperture and provided around same with an upwardly flaring workpiece-receiving formation, an upper plate formed with a throughgoing aperture and provided around same with a downwardly flaring workpiece-receiving formation, means for vertically displacing said lower plate relative to said upper plate to clamp a workpiece between said formations, and means for horizontally displacing said upper plate relative to the respective station out of a position with the respective aperture vertically aligned with said aperture of the respective lower plate for loading of a workpiece into the respective clamp and removing of a workpiece from the respective clamp; and means for displacing said workpiece frame between a pair of positions in each of which a respective station is vertically aligned with said tool in said direction.

* * * * *